US005580396A

United States Patent [19]

Fruchart et al.

[11] Patent Number: 5,580,396

[45] Date of Patent: Dec. 3, 1996

[54] TREATMENT OF PULVERANT MAGNETIC MATERIALS AND PRODUCTS THUS OBTAINED

[75] Inventors: Daniel Fruchart, Echirolles; Salvatore Miraglia, Grenoble; Paul Mollard, Domene; René Perrier de la Bathie, Saint Pierre d'Albigny; Robert Fruchart, La Tronche, all of France

[73] Assignee: Centre National de la Recherche Scientifique (CNRS), France

[21] Appl. No.: 318,909

[22] Filed: Oct. 5, 1994

Related U.S. Application Data

[63] Continuation-in-part of Ser. No. 966,029, Dec. 29, 1992, abandoned.

[30] Foreign Application Priority Data

Jul. 2, 1990 [FR] France ..... 90 08582

[51] Int. Cl.[6] ..... H01F 1/03

[52] U.S. Cl. ..... 148/101; 148/122

[58] Field of Search ..... 148/101, 102, 148/103, 104, 105, 122, 302; 420/83, 121; 241/1, 18, 23, 24, 29, 65

[56] References Cited

U.S. PATENT DOCUMENTS

| | | | |
|---|---|---|---|
| 4,760,966 | 8/1988 | Finnegan et al. | 241/1 |
| 5,096,509 | 3/1992 | Endoh et al. | 148/101 |
| 5,314,548 | 5/1994 | Panchanathan et al. | 148/101 |

FOREIGN PATENT DOCUMENTS

| | | |
|---|---|---|
| 0173588 | 3/1986 | European Pat. Off. . |
| 0304054 | 2/1989 | European Pat. Off. . |

OTHER PUBLICATIONS

Patent Abstracts of Japan, vol. 13, No. 246 (E-769)(3594) Jun. 8, 1989 JP-A-1-48406 (Feb. 22, 1989).
Patent Abstracts of Japan, vol. 13, No. 238 (C-603)(3586) Jun. 5, 1989 JP-A-1-47841 (Feb. 22, 1989).
Patent Abstracts of Japan, vol. 9, No. 277 (E-355)(2000) Nov. 6, 1985 JP-A-60-119701 (Jun. 27, 1985).
Patent Abstracts of Japan, vol. 13, No. 243 (E-768)(3591) Jun. 7, 1989 JP-A-1-45103 (Feb. 17, 1989).
Patent Abstracts of Japan vol. 12, No. 324 (E-653)(3171) Sep. 2, 1988 JP-A-63-90104 (Apr. 21, 1988).

*Primary Examiner*—John Sheehan
*Attorney, Agent, or Firm*—Harris Beach & Wilcox

[57] ABSTRACT

There is disclosed a process for optimizing the magnetic properties of a multiphase product of composition rare earth/iron/boron endowed with permanent magnet properties at ambient temperature. This composition serves as a precursor, which is first subjected to a decrepitation treatment by hydrogenation under low pressure at low temperature to obtain an intermediate hydride in pulverulent form. The pulverulent intermediate hydride is subsequently subjected to a first heat treatment under vacuum for partial dehydrogenation at a temperature below its element separation temperature. The non-separated product thereby obtained is subjected to a second heat post-treatment under an initial primary vacuum and extensively dehydrogenated until the primary vacuum is reestablished at a temperature close to 600° C. The precursor can be an isotropic material obtained by fast quenching, such as wheel quenching or hot welding with a forging ratio of at least 10. According to another aspect of the invention the dehydrogenated product obtained is subjected to a third heat post-treatment under a neutral atmosphere or under vacuum, at a temperature of between 450° and 1000° C. The two post-treatments are optionally separated by a thermal plateau.

9 Claims, 1 Drawing Sheet

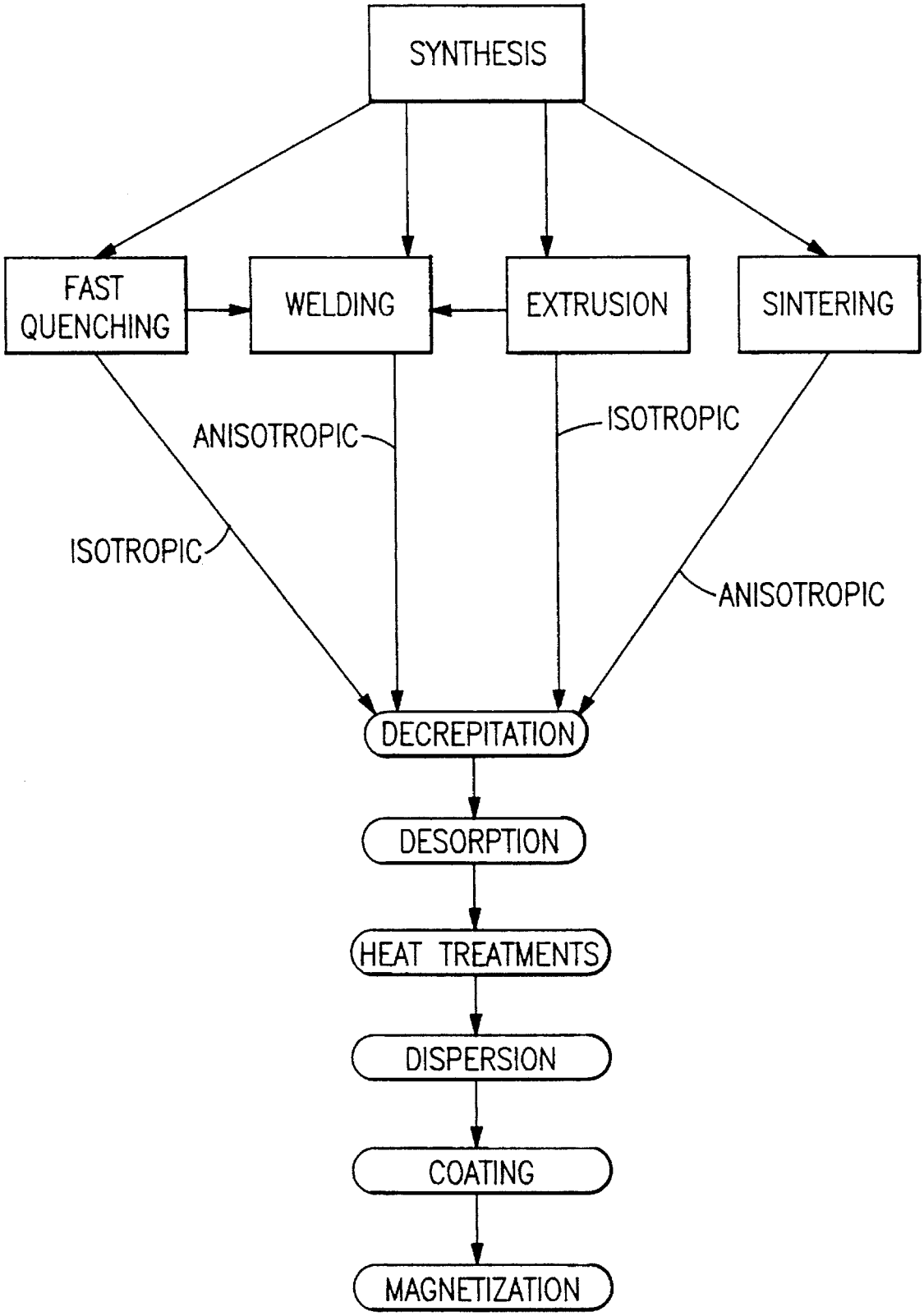
SYNTHESIS
FAST QUENCHING
WELDING
EXTRUSION
SINTERING
ANISOTROPIC
ISOTROPIC
ISOTROPIC
ANISOTROPIC
DECREPITATION
DESORPTION
HEAT TREATMENTS
DISPERSION
COATING
MAGNETIZATION

TREATMENT OF PULVERANT MAGNETIC MATERIALS AND PRODUCTS THUS OBTAINED

This is a continuation-in-part of application Ser. No. 07/966,029 filed on Dec. 29, 1992, now abandoned.

BACKGROUND OF THE INVENTION 1. Field of the Invention

The invention relates to an improved process intended to optimize the magnetic properties of a material provided with permanent magnet properties, with a view to obtaining a product which has high magnetic performance and is in finely divided form. More specifically, it relates to a process suitable for increasing the internal magnetic energy of such a material, of the rare earth/iron/boron alloy type, obtained after decrepitation by a hydrogenation/dehydrogenation procedure. Finally, it also relates to the products obtained by this process.

2. Description of the Prior Art

The need for materials which have high magnetic properties and are in pulverulent form is becoming greater every day, in particular within the framework of their use for the production of sintered or bonded magnets (injected or pressed).

The production of bonded magnets is fundamentally carried out by introducing a large amount of magnetic material in the most finely divided form possible into a continuous organic matrix, generally produced from a synthetic polymer. This step is conventionally carried out using a twin screw, at the melting point of the polymer. In this way, in order to obtain high performance bonded magnets, the aim is to introduce the largest possible amount of magnetic material into the matrix. Within the framework of an optimization of such magnets, the intended aim is to minimize the size of the constituent "particles" of the magnetic material, while improving the magnetic properties and in particular the coercivity of the said "particles". In addition, it is important that the particle size distribution of these "particles" is as narrow as possible, in order, in particular, to optimize the magnetic properties (coercivity, induction) of the bonded magnet.

This property proves particularly important in the context of the production of bonded magnets of high anistropy. In fact, on the one hand the dispersibility of the powders, that is to say their ability to disperse homogeneously, for example in the coating matrix or resin, and, on the other hand, their orientability, that is to say their ability to orient under a magnetic field, and more precisely to align their direction of easy magnetization with the direction of the magnetic field applied, and to do so by mechanical rotation, depend on this narrow distribution and on the effective size of the "particles" obtained.

The interest in obtaining powders which have high magnetic properties and are of homogeneous low particle size is thus clearly apparent. Bonded anisotropic magnets produced from these powders are capable of displaying a very much higher remanent induction than those currently produced using the powders available today, this being achieved from the same "absolute" amount of magnetic material. One of the aims of the present invention is to provide a process suitable for the production of such powders, having a high coercivity.

With regard to the production of magnetic materials which are in pulverulent form, a process termed a "decrepitation" process is described in European patent EP-A-O 173 588, which process comprises at least one hydrogenation/dehydrogenation cycle of a compound having the general formula $R_2M_{14}B$, where B denotes boron and R denotes an element belonging to the group of the rare earths or yttrium, M essentially denoting iron and being able to be partially replaced by other metal elements, enabling a product to be obtained which is of small particle size and has valuable magnetic properties in respect of its magnetization, but generally having an inadequate degree of coercivity.

In fact, it has been possible to show that the magnetic properties of a material were, inter alia, linked to the definition of its microstructure (domain, grain, structure, etc. . . . ). In this way, it has been sought to obtain finely divided materials composed of particles of small size, typically ten micrometers and less, by a process which is easy to carry out and inexpensive and, additionally, without risk for experimenters and producers. This process consists in producing powdering of the base material by hydrogenation. This process, which is termed decrepitation, briefly comprises the absorption of hydrogen by a metal alloy under specific pressure and temperature conditions. This absorption, for which the chemical reaction of binding atomic hydrogen to particular sites of the material gives rise to an evolution of heat, causes an increase in the volume of the alloy, subsequent to the expansion of the crystal lattice, in fact resulting in a dislocation of the solid material. This takes place at two levels, that is to say at an intergranular level, that is to say between the entities of the same phase, and at an intragranular level, corresponding to "bursting" of entities of a given phase. A powder is obtained in agglomerate form, which it is possible to disperse simply by stirring.

It has been found that although the products obtained certainly have a particle size which is completely in accord with the intended aim, on the other hand the magnetic properties obtained must be optimized for some particular applications, in particular for permanent magnets, or for bonded magnets. In fact, the powders obtained certainly have a particle size close to 10 micrometers, or even less; on the other hand, the internal magnetic energy (HB)max developed by said powders remains moderate and in every case is insufficient for the powders to be used as such in the production of permanent magnet/polymers of high capacity.

SUMMARY OF THE INVENTION

The aim of the invention is, using materials having permanent magnet properties—either intrinsically or potentially (for example an amorphous product)—to obtain powders having the same magnetic properties as their precursors by applying heat treatments corresponding to particular conditions. A further aim of the invention is to obtain powders of homogenous low particle size, provided with these magnetic properties. After decrepitation, obtained by hydrogenation followed by partial dehydrogenation carried out under primary vacuum and at a temperature below the magnetic phase separation temperature of the hydride obtained, which temperature is typically in the vicinity of 520° C., optionally followed by heat plateaus, a second heat treatment is applied at a temperature in the vicinity of 600° C., that is to say a temperature higher than the desorption temperature of the hydrides from the main phase of the material.

It has been observed that this heat post-treatment makes it possible to obtain a dehydrogenation of all of the constituent phases of the base alloy. In fact, as is known, whatever the method by which the latter is obtained, it is necessary to pass through a step involving melting of the base material with a view to obtaining an alloy in solid form. As this melting is not congruent, one or more secondary phases displaying eutectic behavior and richer in rare earth elements exist between the predominant entities, which make up the "magnetic" phase proper. In fact, the aim of the subsequent heat treatments is to dehydrogenate this or these secondary phases. Finally, by means of a third heat treatment, it is aimed to reshape the shell having a high concentration of rare earth elements.

In the sense of the invention, "primary vacuum" is understood to be a vacuum of preferably less than $10^{-2}$ to $10^{-4}$ millimeters of mercury (or about 1 to $10^{-2}$ Pa). This primary vacuum is intended to permit removal of gaseous hydrogen at the rate at which it is formed. The duration of the dehydrogenation heat treatments is, moreover, linked to the restoration of the initial primary vacuum.

The duration of the dehydrogenation treatment depends on the base material used. It is followed by cooling at a constant rate, said rate also depending on the starting material.

In other applications, this first post treatment may be followed by a heat plateau and then by subsequent heat treatments, the aim of which is similar to that of the first treatment.

The second treatment for extensive dehydrogenation, and that for high-temperature annealing (third treatment) may not be carried out directly on the bonded magnets, taking account of the low melting point of their matrix. In this way, in order to improve the magnetic properties of the bonded magnets, it was important to improve the magnetic properties of the powders obtained by decrepitation, in accordance with the process described in the document EP-A-O 173 588, which has already been mentioned.

In the publication by TAKESHITA (No. 18P0216 of the 10th International Workshop on Rare-Earth Magnets and Their Applications, Kyoto, Japan, 16–19 May 1989) it has certainly been shown that, by subjecting an ingot of a Nd—Fe—B alloy to a stream of gaseous hydrogen at a temperature of between 750° and 900° C. for a period of between one and three hours, followed by a stage of about 1 hour under vacuum, at the same temperature, and finally by quenching to ambient temperature, it was possible to obtain powders having relatively good magnetic properties. On the other hand, a process of this type leads to the element separation of the main phase of the base multiphase material and is able to lead only to the production of magnetically isotropic products, whatever the precursor.

In fact, only the powders which have anisotropic magnetic characteristics make it possible to obtain, by orientation under a magnetic field, sintered or bonded materials which have a remanent magnetism which increases as a result of the effect of orientation of the particles in a parallel direction. On the other hand, the use of magnetically isotropic powders does not permit the magnetization (the remanent magnetism) of the sintered or bonded materials produced from said powders to be increased when they are oriented under a magnetic field.

To date, it is not known how to prepare fine and homogeneous powders of rare earth/iron/boron alloys which have a very high anisotropy and high magnetic properties, permitting, for example, an increase of more than 60 to 80% in their magnetization by orientation under a field, and suitable for the production of bonded magnets having a very high magnetization and coercivity.

Various methods have, however, been proposed for the preparation of powders having a certain degree of anisotropy. One of these, described, for example, in the document EP-A-O 302 947, consists in mechanically grinding an anisotropic solid alloy which has previously been subjected to a suitable mechanical treatment. Although the products obtained certainly have some magnetic anisotropy, which is inherent to the starting material and is not altered or is little altered by the treatment to which it is subjected, on the other hand the coercivity which they develop after treatment is relatively low, said coercivity being severely modified by the treatments for reduction of the particle size, in particular mechanical treatments. It is thus apparent that mechanical grinding proves particularly poorly suited for the production of homogeneous fine powders, taking into account the considerable deterioration which it causes in the magnetic properties of the precursor.

Another approach, described, in particular, in the document EP-A-0 304 054, in contrast consists in using an isotropic powder of fine and uniform particle size, obtained, for example, by decrepitation in hydrogen at very high temperature (600° to 900° C.), as starting material and then subjecting this powder to a treatment of the hot plastic deformation type (analogous to that carried out in the above case on the precursor) intended to give rise to a certain degree of anisotropy in the said powder without, however, risking causing its sintering. Powders of small particle size are certainly obtained, but the magnetic properties of these powders, in particular any anisotropy of the precursor, are considerably diminished or even destroyed, because of the separation of the magnetic phases making up the base magnetic structure, this separation being inherent to the treatment under hydrogen at high temperature.

The above noted document EP 0 304 054 discloses a process of hydrogenating and dehydrogenating $R_2Fe_{14}B$ alloys, wherein the dehydrogenation occurs under a vacuum at a temperature between 500° C. and 1000° C. This process is known as HDDR, or hydrogen disproportionation dehydrogenation recrystallization. It is necessary, according to EP 0 304 054, for a structural change to occur during interaction with hydrogen in order that a recrystallized grain structure can develop. In this respect EP 0 304 054 states in relevant part:

"The process of the invention is characterized by the steps of:

(a) preparing a rare earth-iron-boron alloy material in the form of ingot, powder, homogenized ingot or homogenized powder;

(b) subsequently occluding hydrogen into the alloy material by holding the material at a temperature of 500° C. to 1,000° C. either in a hydrogen gas atmosphere or in a mixed gas atmosphere of hydrogen and inert gases;

(c) subsequently subjecting the alloy material to dehydrogenation at a temperature of 500° C. to 1,000° C. until the atmosphere becomes a vacuum atmosphere wherein the pressure of hydrogen gas is reduced to no greater than $1\times10^{-1}$ torr or an inert gas atmosphere wherein the partial pressure of hydrogen gas is reduced to no greater than $1\times10^{-1}$ torr; and . . .

In the step (b), the hydrogen gas atmosphere or the mixed gas atmosphere of hydrogen and inert gases is selected to be used. This is because such atmosphere is not only suitable for relieving strain in the material and causing the hydrogenation while preventing the oxidation, but also causes a structural change in the material to grow a recrystallized grain structure therein. If the material should be held in other atmosphere such as of only inert gas or of a vacuum, no recrystallized grain structure can be obtained . . .

The expression "holding the material at a temperature of 500° C. to 1,000° C." means not only the case where the alloy is kept at a constant temperature in the range of 500° C. to 1,000° C., but also the case where the temperature is varied up and down within the above range . . . Further, the coercivities and magnetic anisotropy of the magnet powder to be obtained can be controlled by regulating the holding temperature within the range of 500° C. to 1,000° C., the holding time and the pressure of hydrogen gas. If the holding temperature is set to be lower than 500° C., a sufficient structural change cannot be caused in the magnet powder. On the other hand, if the temperature is higher than 1,000° C., hydrogenized matters or particles of powder are welded to each other, and besides the structural change is caused too much, so that the recrystallized grains grow to such an extent that the coercivities are lowered.

After the termination of the above step (b), the dehydrogenation is carried out in the step (c) until the hydrogen atmosphere becomes a vacuum atmosphere wherein the pressure of hydrogen gas is reduced to no greater than $1\times10^{-1}$ torr or until the mixed gas atmosphere becomes an inert gas atmosphere wherein the partial pressure of hydrogen gas is reduced to no greater than $1\times10^{-1}$ torr. The purpose of the dehydrogenation step is to remove hydrogen from the alloy magnet powder almost completely. If hydrogen should remain in the magnet powder, high coercivities cannot be obtained. In order to ensure the almost complete dehydrogenation, the pressure of hydrogen or the partial pressure of hydrogen has to be decreased to $1\times10^{-1}$ torr, and the dehydrogenation temperature has to be kept in the range of 500° C. to 1000° C. If the pressure exceeds the above value, dehydrogenation becomes insufficient. Similarly, if the dehydrogenation temperature is less than 500° C., hydrogen remains in the magnet powder even though the pressure is decreased to no greater than $1\times10^{-5}$ torr."

Applicant believes that in discussing structural change EP 0 304 054 refers to the well known separation of magnetic phases that occurs at a critical temperature that is specific to the particular alloy. This temperature can be as low as 500°–520° C., depending on the particular alloy composition. This phenomenon, induced by hydrogen gas occluded into a metal material having magnetic properties, typically Nd—Fe—B, produces a complete change in the crystal structure of the material. Through a chemical separation of the elemental components, the "structural change" is a transformation of the starting defined compound into an intimate mixture of elemental constituents. The phenomenon is temperature dependent, beginning at around 500°–520° C., and markedly increasing in rate at higher temperatures, depending on the applied gas pressure, the composition of the starting alloy, and the surface cleanliness of the ingots.

The process according to the invention eliminates the occurrence of "structural change" as described in EP 0 304 054 during the steps of occlusion by hydrogen and subsequent dehydrogenation. According to the invention, hydrogen gas is reacted with a magnetic alloy, typically Nd—Fe—B, The reaction with hydrogen gas is conducted at a moderate rate, and at a moderate temperature, always below the critical temperature at which phase separation occurs. It is essential that no structural change as described in EP 0 304 054 occur. The reaction can be conducted up to the critical temperature, but preferably is conducted at a much lower temperature, below 500° C. Following dehydrogenation, the alloy is submitted to final heat treatments in order to achieve full coherency of the preserved initial structure within the individual grains, thus optimizing the initially existing magnetic properties of the bulk alloy.

In contrast, within the framework of the present invention, the aim was a method of treatment in combination with an appropriate precursor composition making it possible to give rise to a maximum degree of magnetic anisotropy in this precursor. Use was made of a particle size reduction technique such as decrepitation in hydrogen, carried out under moderate temperature conditions, followed by a suitable post-treatment for dehydrogenation, suitable for integral retention of the very high anisotropy of the precursor used to this end.

The starting material therefore plays a fundamental role, both in respect of its composition and in respect of its isotropic or anisotropic character, the latter being retained throughout the successive steps of decrepitation and post-treatments. In fact, this product is advantageously a rare earth/iron/boron alloy, it being possible for the iron to be partially replaced by cobalt or by other transition elements (3d, 4d, 5d). Advantageously, and when it is desired to obtain optimum magnetic properties, it is possible to replace part of these iron or cobalt elements by other elements such as copper or aluminum.

For subsequent production of oriented sintered or bonded magnets, it is essential to use, as starting material, a precursor having anisotropic magnetic properties, so as to obtain highly anisotropic decrepitated powder, the particles of which are capable of orienting themselves under the effect of an external magnetic field. In this case, this orientation in fact contributes to a considerable increase in the remanent induction of the sintered or bonded magnet thus produced, whereas in the case of a product having isotropic magnetic properties, the orientation treatment under a magnetic field remains without effect.

A precursor which is highly anisotropic (with regard to its magnetic characteristics) is obtained if materials obtained by the "powder metallurgy" technique, described in more detail in the document EP-A-0 101 552, are used or if solid magnetic scrap is used as starting material. The precursors obtained from a hot-welding treatment of the hammering or pressing type, described in the document WO 87/07425, also have these characteristics of high magnetic anisotropy. There are also precursors of this type having high magnetic anisotropy obtained from a specific fast quenching treatment.

The solid or strip precursors having, in contrast, isotropic magnetic properties are obtained within the framework of hot-welding processes carried out by extrusion, also described in the document WO 87/07425, or in the fast quenching process on rollers, described, in particular, in the document EP-A-0 108 474.

The invention also relates to the product obtained. It is a product which has good magnetic properties, typically an internal energy (HB)max of greater than or equal to 80 $kJ/m^3$ for the isotropic powders and 240 $kJ/m^3$ for the anisotropic powders, with a homogeneous small particle size, typically of close to 10 micrometers, or less, and always less than fifteen (15) micrometers. Advantageously, these products have a remanent magnetization, typically of at least 40 $Am^2/kg$ for the isotropic powders and 80 $Am^2/kg$ for the orientated anisotropic powders, and a high coercivity of at least 700 kA/m. Moreover, when the precursor is produced by hot-welding, the grains of the products obtained have a characteristic habit in the form of broken crystallites, typical of the morphology resulting from this production process.

It was certainly known how to obtain materials having high magnetic properties, such as, for example, a magnetic internal energy of greater than or equal to 200 kJ/m$^3$. This type of material is described, for example, in the publication by SHIMODA et al (J. APPL. PHYS. 64 10), in which it has been proposed to produce permanent magnets based on a praseodymium/iron/boron/copper mixture and to do so with a low degree of reduction, in particular of less than 90%. This production process is carried out by hot pressing, at a temperature of about 1000° C.

The magnets obtained certainly have high magnetic properties, but their size is small. Moreover, taking account of their production process, in particular by rolling under a cover, certainly grain refining (although inadequate with a degree of reduction of less than 90%) and, in particular, a heterogeneous particle size distribution and heterogeneous microstructure are obtained. Finally, good magnetic properties may be obtained only by using praseodymium. In fact, it is clearly indicated that the magnetic properties tend to fall drastically if praseodymium is replaced by neodymium. The disadvantage of using praseodymium lies in its high cost, taking account of its relatively low occurrence in nature compared with neodymium.

Products provided with magnetic properties which have a homogeneous and small particle size, the limit of which may be less than 0.1 μm, are also known. These products are obtained, for example, by means of the process described in the document EP-A-0 173 588, which has already been mentioned. As already stated, decrepitation of the products by hydrogenation/dehydrogenation certainly enables products of small particle size to be obtained, but with a significant loss of magnetic properties.

Consideration was then given to applying mechanical treatments, with a view to reducing the particle size, to the products obtained by quenching and having good magnetic properties. These products are, for example, in the form of pre-orientated platelets, leading to some anisotropy. However, in practice it is found that the application of mechanical grinding also alters the magnetic properties, in particular because of mechanical impacts. Consequently, to date there are no pulverulent products which have, at one and the same time, a homogeneous small particle size, of the order of ten micrometers, or even less, and high magnetic properties, in particular in the case of the highly anisotropic powders, which develop a remanent induction in the oriented form $Br_{oriented}$ such that the ratio:

$$\frac{Br_{oriented} - Br_{non\text{-}oriented}}{Br_{oriented}}$$

is greater than or equal to 80%.

The starting material is a material which already has high magnetic properties in the solid state. The process according to the invention aims, following a decrepitation having reduced its magnetic properties, to restore said properties in order to yield magnetic properties, in particular in respect of coercivity, and remanent induction, close to those of the crude starting material.

BRIEF DESCRIPTION OF THE DRAWINGS

FIG. 1 is a block diagram depicting the various steps involved in the production of a bonded magnet according to the invention.

DESCRIPTION OF THE PREFERRED EMBODIMENT

According to the process, the starting material is an isotropic or anisotropic polyphase alloy, depending on the destination of the final product, of composition rare earth/iron/boron. In a known manner, the iron may be replaced by cobalt, in particular with a view to increasing the Curie point of the final product, or by other 3d transition metals, such as copper, or 4d and 5d. Moreover, iron may also be partially replaced by other metal elements, such as aluminum, and this replacement can be cumulative with the transition elements. Advantageously, some of the rare earth atoms may be replaced by others, such as dysprosium, depending on the types of magnetic properties required.

As already stated, this alloy is in polyphase form, respectively a magnetic phase of high anisotropy, having the general formula $$R_2—M_{14}—B,$$

and one or more other phases having a predominant concentration of rare earth elements, resulting from the method of production of the base material.

The method by which the starting materials are obtained will not be described in detail. As already stated, they may be obtained by the technique known as "rapid quenching", mechanical grinding at elevated temperature or welding or even by the powder metallurgy technique, that is to say from sintered powders previously oriented under a magnetic field.

Once this base material has been obtained, it is first hydrogenated by absorption of hydrogen under pressure (1 to 5 MPa), for example in an autoclave made of special steel, and generally at ambient temperature. However, in some cases, thermal activation proves necessary. Whatever the case, one or more heat cycles during the hydrogenation stage ensure a better chemical and particle size homogeneity of the material. This hydrogenation leads to the fragmentation of the material, which then becomes very easily dispersible. The production of the pulverulent form of the material may be obtained simply by mechanical stirring, or simply by grinding.

According to the process of the invention, the hydrogenated pulverulent material is subjected to three treatment stages:

During a first stage, a partial dehydrogenation is carried out which relates to the main hydrogenated phase $R_2—M_{14}—B—H_x$ (where x is between 1 and 5), the latter being converted to $R_2—M_{14}—B$.

In fact, as the hydrides formed are of metastable type, the dehydrogenation must be carried out under low vacuum at a temperature below their magnetic phase separation temperature; if these conditions are not observed the formation of hydrides of rare earths, iron and a poorly defined iron/boron phase is observed, the magnetic properties of the material then being definitively and effectively altered. It is essential that no structural change in the sense of EP 0 304 054 occur.

The temperature for this partial dehydrogenation, which may start under low vacuum at about 150° C. and which rises to about 300° C., must not exceed 520° C., the magnetic phase separation temperature of the $R_2—M_{14}—B—H_x$ hydrides. The reaction can effectively be performed below 500° C., which guarantees that no structural change occurs as the term is used in EP 0 304 054.

During a second treatment stage, which is carried out at a temperature of the order of 600° C., the complete dehydrogenation of the decrepitated material may be conducted, in particular in respect of the eutectic phase rich in rare earths, which forms the pellicular shell of the magnetic domains. This second stage is also carried out under low vacuum.

Finally, the dehydrogenated powder thus obtained may be subjected, in a third stage, to an annealing treatment at between 450° and 1000° C., with the aim of completely restoring the magnetic properties, in particular the coercivity.

It is found that all risk of sintering of the remanent material, a result which is counter to the desired morphology, is avoided by treating the materials in this temperature range.

The treatment may advantageously be completed by an in-situ passivation by introducing argon under normal pressure, before returning the product to its normal temperature.

The aim of the final heat treatments (thermal plateaus) is to optimize the cohesion of the granular material, that is to say the phase of type $R_2$—$M_{14}$—B and its eutectic intergranular shell, at the level of the elementary particles. The various parameters for these heat treatments, respectively temperature, duration and cycle, depend on the composition of the base material and their metallurgical synthesis process.

Different types of starting materials (in the sense of the metallurgy of their preparation) are chosen depending on whether it is desired to given preference to the magnetization properties or the coercivity properties. Similarly, and as already stated, the choice of starting material also depends on the desired anisotropy of the final product. This choice is involved both in its composition and in its synthesis process.

A block diagram of the various steps involved in the production of a bonded magnet is shown in FIG. 1. In addition to the steps mentioned above, the powders obtained after the various heat treatments are dispersed before being coated in a resin and then oriented under a field.

In order to illustrate the process according to the invention, various examples of the production of products are described below, with the resulting magnetic properties.

EXAMPLE 1: Stage a

The precursor material used is an isotropic compound having the following chemical formula:

$$Nd_{14}Dy_{1.5}Nb_{0.7}Fe_{76}.8B_7$$

obtained by fast quenching at a rate of 50 m/s. When sintered in solid form, a material of this type is known to have good magnetic properties, such as:

remanent induction: 85 $Am^2/kg$ coercive field: 1,250 kA/m

This material is subjected to a decrepitation treatment by hydrogenation and desorption is conducted by a heat treatment from 180° C. This treatment, the aim of which is to desorb hydrogen from the main phase, is carried out at a rate of 300° C./hour. It is the stage termed dehydrogenation, carried out under low vacuum, not permitting the temperature to rise above 495° C. It is followed by a thermal plateau for one hour at 495° C. and finally by cooling at a rate of 150° C./hour.

A remanent induction of 42 $Am^2/kg$, but a very much reduced coercive field of 120 kA/m, are obtained for this isotropic finely divided material, which makes this material unusable for converting to the bonded magnet form.

EXAMPLE 1: Stage b

The same treatment as in phase a is repeated, using the same material, and then the latter is subjected to a second heating stage at 600° C., which temperature is obtained at the rate of 300° C./hour. This treatment is followed by heating at 640° C., which temperature is obtained at a rate of 50° C./hour, the thermal plateau at 640° C. being held for 30 minutes. This stage is followed by rapid cooling to 600° C., at a rate of 1000° C./hour, followed by a fall in temperature of 150° C./hour.

The results obtained are, respectively:

a remanent induction of 56 $Am^2/kg$ on a non-oriented sample of compaction 0.4;

and a coercive field of 1100 kA/m.

It may be pointed out that the effect of the second treatment on the material enables the initial magnetic properties to be restored to some extent.

EXAMPLE 2: Stage a

The starting material is an isotropic precursor material having the formula:

$$Nd_{16}Fe_{77}AlB_6$$

obtained by hot-welding by extrusion, with a forging ratio of 12. In the solid form, this material has the following magnetic characteristics:

remanent induction: 75 $Am^2/kg$ coercive field: 950 kA/m

This material is decrepitated and then subjected to a heat treatment in the same way as described in Example 1, stage a. The remanent induction of the non-oriented sample of compaction 0.4 is 43 $Am^2/kg$, the coercive field being only 320 kA/m.

EXAMPLE 2: Stage b

The same precursor material, which has been subjected to the treatment of Example 1 (stage a), is then subjected to heating at 600° C., which temperature is obtained at a rate of 300° C./hour. It is then treated in accordance with the same procedure as indicated in Example 1, stage b.

The remanent induction determined on a non-oriented sample of compaction 0.4 is 43 $Am^2/kg$, and the coercive field 880 kA/m. As in the previous case, the isotropic magnetic characteristics of the solid material are therefore restored to a large extent.

EXAMPLE 3

The starting material used is an anisotropic precursor material having the empirical formula:

$$Nd_{15}DyFe_{78}B_6$$

obtained by extrusion and forging by hot welding (forging ratio: 10). The initial magnetic characteristics of the material in solid form are, respectively:

remanent induction: 75 $Am^2/kg$ coercive field: 1,430 kA/m.

The material is decrepitated by hydrogenation and then heated at 495° C. under low vacuum, the temperature being obtained at a rate of 300° C./hour. It is subjected to a thermal plateau for a period of one hour at this temperature and is then heated to 600° C., which temperature is obtained at a rate of 300° C./hour. It is then heated to 680° C., obtained at a rate of 100° C./hour. It is then subjected to a thermal plateau for 20 minutes at 680° C. and is then rapidly cooled to 600° C. at a rate of 600° C./hour, followed by a fall in temperature at 150° C./hour.

The sample, in the form of non-oriented anisotropic powder of compaction 0.4, has a remanent induction of 40 $Am^2/kg$ with a coercive field of 1,200 kA/m.

The initial magnetic characteristics of the material are once again restored.

EXAMPLE 4

The starting material used is an anisotropic precursor material having the empirical formula:

$$Nd_{16}Cu_2Fe_{76}B_6$$

obtained by forging by hot welding, with a forging ratio of 10. The initial magnetic characteristics of this material in solid form are, respectively:

remanent induction: 116 $Am^2/kg$ coercive field: 1,030 kA/m

This material is then treated as indicated in Example 3. The magnetic properties obtained for the powder thus obtained, in the non-oriented state, of compaction 0.4, are:

remanent induction: 53 $Am^2/kg$ coercive field: 720 kA/m.

This powder is then subjected to a heat treatment at 1000° C. and then at 500° C. and is then coated with a resin under a magnetic field. The characteristics of the oriented powder thus introduced become:

remanent induction: 96 $Am^2/kg$ coercive field: 720 kA/m.

Thus, it can be seen from the above examples that the products obtained, which have a typical particle size of close to ten micrometers, have very valuable magnetic properties, since a suitable heat treatment has been applied to them. In particular it is found that very good values are obtained for the coercivity, which values are close to the values obtained for this parameter with the precursor solid products. The fundamental role played by the precursor material, in particular when it is desired to give preference to the coercivity, it thus clearly apparent.

All of these materials have a high remanent induction, which has been characterized on a non-oriented pulverulent sample of relative compaction close to 0.4.

The powders thus obtained, taking account of their homogeneous small particle size on the one hand and of their high magnetic properties on the other hand, have made it possible to produce anisotropic bonded magnets, in the case of which the measured remanent induction is 30 to 40% higher than that of the anisotropic bonded magnets currently available, this result being obtained with essentially the same charge of magnetic material.

We claim:

1. Process for optimizing the magnetic properties of a multiphase product of composition rare earth/iron/boron endowed with permanent magnet properties at ambient temperature, and having a base magnetic structure comprising a plurality of magnetic phases, said product having a specific critical temperature at which said magnetic phases separate and a structural change occurs, said product being subjected to a decrepitation treatment comprising hydrogenation followed by dehydrogenation under reduced pressure and said step of hydrogenation being performed at a temperature that is less than said specific critical temperature to obtain an intermediate hydride in pulverulent form, characterized:

in that the pulverulent intermediate hydride is subjected, subsequent to the decrepitation, to a first heat treatment under vacuum for partial dehydrogenation at a temperature below said specific critical temperature, said first heat treatment being performed until a primary vacuum is attained, and in that the material thereby obtained is subjected to a second heat post-treatment for extensive dehydrogenation said second heat post-treatment being performed until a primary vacuum is attained at a temperature of about 600° C.

2. Process according to claim 1, characterized in that the dehydrogenated product obtained is subjected to a third heat post-treatment under a neutral atmosphere or under vacuum, at a temperature of between 450° and 1000° C., said third heat post-treatment being performed until a primary vacuum is attained.

3. Process according to claim 1, characterized in that the product predominantly has a tetragonal phase $R_2$—$M_{14}$—B, the magnetic phase separation temperature of which is close to 520° C., in which:

B denotes boron;

R denotes an element selected from the group of rare earths and yttrium; and

M is iron optionally in an admixture with at least one of a transition element and/or a metal element.

4. Process according to claim 2, wherein said dehydrogenated product is maintained at a substantially constant temperature during a time interval that separates said second heat treatment and said third heat treatment.

5. Process according to claim 3, wherein said transition element is cobalt and said other metal element selected from the group consisting of aluminum and copper.

6. Process according to claim 3, wherein said transition element is cobalt.

7. Process for optimizing the magnetic properties of a multiphase product of composition rare earth/iron/boron endowed with permanent magnet properties at ambient temperature, and having a base magnetic structure comprising a plurality of magnetic phases, said product being subjected to a treatment comprising the steps of:

hydrogenating the composition at a temperature that is less than 500° C. to obtain an intermediate hydride in pulverulent form;

subjecting the pulverulent intermediate hydride to a first heat treatment under vacuum for partial dehydrogenation at a temperature that is less than 500° C. until a primary vacuum is attained; and subjecting a material thereby obtained to a second heat treatment under vacuum for further dehydrogenation at a temperature of about 600° C. until a primary vacuum is attained.

8. Process for optimizing the magnetic properties of a multiphase product of composition rare earth/iron/boron endowed with permanent magnet properties at ambient temperature, and having grains and an initial base magnetic structure comprising a plurality of magnetic phases, the product having a specific critical temperature above which a structural change occurs therein that allows recrystallization of the product to occur, said product being subjected to a treatment comprising the steps of:

hydrogenating the product at a temperature that is less than said specific critical temperature to obtain an intermediate hydride in pulverulent form;

subjecting the pulverulent intermediate hydride to a first heat treatment under vacuum for partial dehydrogenation at a temperature that is less than said specific critical temperature until a primary vacuum is attained; and subjecting a material thereby obtained to a second heat treatment under vacuum for further dehydrogenation at a temperature of about 600° C. until a primary vacuum is attained;

whereby the initial structure within individual grains of the product is preserved.

9. Process for optimizing the magnetic properties of a multiphase product of composition rare earth/iron/boron endowed with permanent magnet properties at ambient temperature, and having grains and an initial base magnetic structure comprising a plurality of magnetic phases, the product having a specific critical temperature above which a structural change occurs therein that allows recrystallization of the product to occur, said product being subjected to a treatment comprising the steps of:

hydrogenating the product to obtain an intermediate hydride in pulverulent form;

subjecting the pulverulent intermediate hydride to a first heat treatment under vacuum for partial dehydrogenation until a primary vacuum is attained, wherein said structural change is avoided while performing said steps of hydrogenating and subjecting the pulverulent intermediate hydride to said first heat treatment; and subjecting a material thereby obtained to a second heat treatment under vacuum for further dehydrogenation at a temperature of about 600° C. until a primary vacuum is attained;

whereby the initial structure within individual grains of the product is preserved.

* * * * *